US005478751A

United States Patent [19]

Oosta et al.

[11] Patent Number: 5,478,751

[45] Date of Patent: Dec. 26, 1995

[54] SELF-VENTING IMMUNODIAGNOSITIC DEVICES AND METHODS OF PERFORMING ASSAYS

[75] Inventors: Gary M. Oosta, Gurnee, Ill.; Thomas G. Schapira, Bristol, Wis.

[73] Assignee: Abbott Laboratories, Abbott Park, Ill.

[21] Appl. No.: 229,256

[22] Filed: Apr. 18, 1994

Related U.S. Application Data

[63] Continuation-in-part of Ser. No. 174,973, Dec. 29, 1993, abandoned.

[51] Int. Cl.[6] ..... G01N 21/03

[52] U.S. Cl. ..... 436/165; 436/178; 422/58; 422/81; 435/4

[58] Field of Search ..... 435/4, 435.71, 435/14, 25, 28, 810, 970; 436/535, 63, 166, 178, 165, 809; 422/58, 61, 81

[56] References Cited

U.S. PATENT DOCUMENTS

| | | | |
|---|---|---|---|
| 3,799,742 | 3/1974 | Coleman et al. | 23/253 |
| 3,921,460 | 11/1975 | Schmidlin | 73/425.6 |
| 4,043,678 | 8/1977 | Farrell et al. | 356/246 |
| 4,323,536 | 4/1982 | Columbus | 422/56 |
| 4,596,695 | 6/1986 | Cottingham | 435/13 |
| 4,756,884 | 7/1988 | Hillman et al. | 422/73 |
| 4,849,340 | 7/1989 | Oberhardt | 435/13 |
| 4,946,795 | 8/1990 | Gibbons et al. | 436/179 |
| 4,952,516 | 8/1990 | Matkovich | 436/170 |
| 4,963,498 | 10/1990 | Hillman et al. | 436/69 |
| 4,981,805 | 1/1991 | Yazawa et al. | 436/169 |
| 5,039,617 | 8/1991 | McDonald et al. | 436/69 |
| 5,135,719 | 8/1992 | Hillman et al. | 422/101 |
| 5,135,873 | 8/1992 | Patel et al. | 436/180 |
| 5,147,606 | 9/1992 | Charlton et al. | 422/56 |
| 5,222,808 | 6/1993 | Sugarman et al. | 366/274 |
| 5,223,219 | 6/1993 | Subramanian et al. | 422/55 |
| 5,230,866 | 7/1993 | Shartle et al. | 422/103 |
| 5,288,463 | 2/1994 | Chemilli | 422/58 |

FOREIGN PATENT DOCUMENTS

| | | |
|---|---|---|
| 0295069A2 | 12/1988 | European Pat. Off. . |
| 470438 | 2/1992 | European Pat. Off. . |
| WO92/08972 | 5/1992 | WIPO . |
| WO94/11489 | 5/1994 | WIPO . |

*Primary Examiner*—Robert J. Warden
*Assistant Examiner*—N. Bhat
*Attorney, Agent, or Firm*—Gregory W. Steele

[57] ABSTRACT

Methods and devices are provided involving an inlet port, at least one chamber, a channel providing access for fluids to flow through via capillary action or differential pressure, reagents, detection means and self-venting materials. The devices allow for the appropriate mixing, reacting, incubating needed to give a detectable signal which can be read. The self-venting materials allow for the 1) displacement of gases inside a track to the outside of the device and 2) oxygen movement into the track from the outside.

44 Claims, 2 Drawing Sheets

SELF-VENTING IMMUNODIAGNOSITIC DEVICES AND METHODS OF PERFORMING ASSAYS

This application is a continuation-in-part of U.S. patent application Ser. No. 08/174,973 filed Dec. 29, 1993, entitled, "SELF-VENTING IMMUNODIAGNOSTIC DEVICES AND METHODS OF PERFORMING ASSAYS" now abandoned.

FIELD OF THE INVENTION

This invention relates to analytical devices for detecting analytes in a test sample utilizing unique venting methods in the device.

BACKGROUND OF THE INVENTION

The qualitative or quantitative determination of analytes in test samples continues to be important in the diagnoses of physiological and non-physiological conditions. The analysis of a test sample mixed with reagents results in a detectable signal which can be evaluated with the aid of instrumentation.

Methods and devices have been provided which give determinations of a variety of analytes in a test sample. Such devices generally involve an inlet port, at least one chamber, at least one capillary, a vent, and at least one reagent providing for a detectable signal. Additionally, several chambers, capillaries and reagents can be provided in a single device permitting complex determinations.

U.S. Pat. No. 4,756,884 to Biotrack, Inc. teaches a capillary flow device which detects antigns in blood samples. Reagents are supplied in the track which can affect blood clotting or antibodies which can cause changes in the flow of sample in the track pathway. U.S. Pat. No. 5,135,719 to Biotrack teaches a blood separation device which separates plasma from red blood cells by use of a filter. Capillary action drives the separation procedure.

Typically, such devices have vents on one of the surfaces of the device. The vent is required to allow air to be displaced as liquid fills the track. The vents on the surfaces are troublesome since they generally have to be added by a separate process step. Vent holes are also problem some in that an air bubble is typically trapped at the site of the vent hole. If the device is jostled, the bubble may move into the track and interfere with assay mechanics or detection. In addition, if the vent is large and the device is angled, liquid may leak out. These issues impart extra design constraints or manufacturing control to insure proper sizing and positioning of the vent hole. Moreover, where a long residence time in a particular chamber is needed in a multistep reaction, the vents may be closed and opened accordingly to control fluid flow.

U.S. Pat. 4,952,516 to Pall Corporation, teaches a self-venting diagnostic test device which includes a porous absorbent which draws liquid through a microporous medium. A liquophobic material vents gases while preventing liquid from passing through the gas vent.

These references fail to teach self-venting capillary diagnostic devices which can vent along the length of a track.

SUMMARY OF THE INVENTION

The present invention advantageously uses analytical devices which can self-vent in capillary tracks. The analytical devices are comprised of materials which facilitate fluid flow through capillary action or differential pressure while venting gases through the material, thereby eliminating the need for vents to be mechanically placed in the device. Such analytical devices can be utilized in homogenous and heterogenous assays to determine the presence or amount of an analyte in a test sample.

The analytical devices of the present invention includes an inlet port or entry port which provides an access to a capillary channel or chamber. The capillary channel can be a conduit to one or more reaction zones, mixing chambers, incubation chambers and the like.

According to one embodiment of the present invention, an analytical device is comprised completely of a hydrophobic material. Such a device includes an inlet port accessing a track that was bored into the material. The surface on which the test sample will access inside the device can be chemically treated to create a hydrophilic surface. The hydrophilic surface can have reagents applied onto its surface to react with the test sample. The track may have a capillary channel which can provide a means for the fluid to travel to various chambers. Additionally, the device must vent gases trapped in the device out through the material. The material also allows oxygen into the device whereby particular assays can be facilitated by the utilization of oxygen. This can be an important function of the present invention wherein oxygen can move into the analytical device along the length of the track.

In addition, according to another embodiment of the present invention, an analytical device can comprise at least two materials. Such devices can use layers of material superimposed on each other and bonded together by various methods such as, but not intended to be limited to, adhesives, heat sealing, ultrasonic welding, or the like. This permits a stratification of layers whereby some layers can be hydrophobic while some layers are hydrophilic. Once again, the venting of gases from inside the device to the outside is accomplished by selecting materials which can permeate gas but not biological liquids, such as test samples.

The present invention also includes methods of performing assays utilizing analytical devices of the present invention.

DETAILED DESCRIPTION OF THE INVENTION

Definitions

Figure 1:
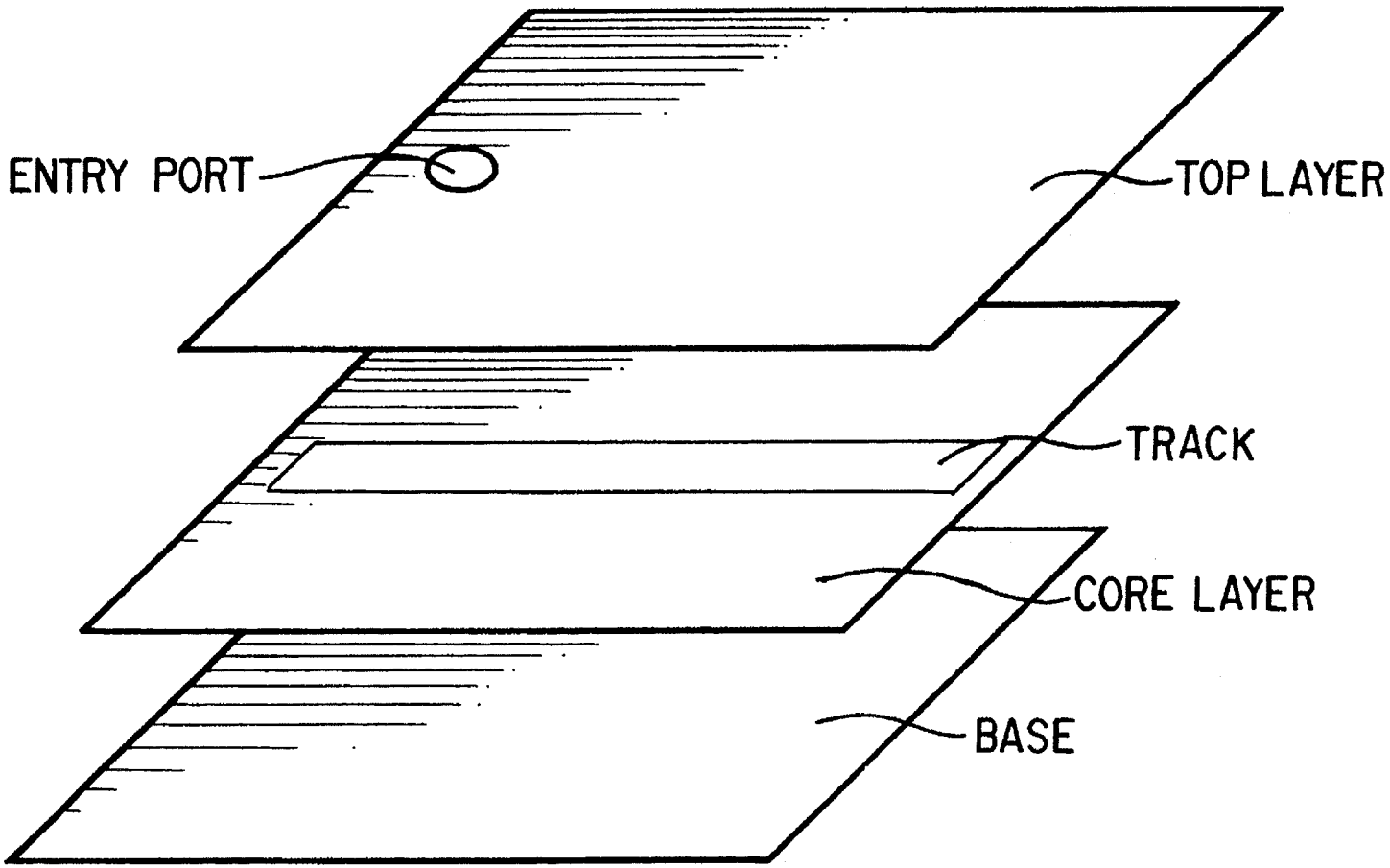
FIG. 1 illustrates one version of an analytical device composed of three different layers; a top layer, core layer, and a base layer.

"Analyte," as used herein, is the substance to be detected in the test sample using the present invention. Analytes thus includes antigenic substances, haptens, antibodies, and combinations thereof. Thus an analyte can be a protein, a peptide, an amino acid, a carbohydrate, a hormone, asteroid, a vitamin, a lipid, a nucleic acid, a peptide, a trace element, a drug including those administered for therapeutic purposes as well as those administered for illicit purposes, a bacterium, a virus, and a metabolite of or an antibody to any of the above substances.

"Binding molecule" as used herein, is a member of a binding molecule pair, i.e., two different molecules where one of the molecules, through chemical or physical means, specifically binds to the second molecule. In addition to antigen and antibody binding molecules, other binding molecules include biotin and avidin, carbohydrates and lectins, complementary nucleotide sequences (including probe and captured nucleic acid sequences used in DNA hybridization assays to detect a nucleic acid sequence), effector and receptor molecules, enzyme cofactors and enzymes, enzyme inhibitors and enzymes, and the like. Furthermore, binding molecules can include members that are analogs of the original binding molecule. For example, a derivative or fragment of the analyte, e.g., an analyte-analog can be used which has at least one epitope or binding site in common with the analyte. Immunoreactive binding molecules include antigens, haptens, antibodies, and complexes thereof including those formed by recombinant DNA methods or peptide synthesis.

"Capillary", as used herein, is a solid surface surrounding a void, in which air can be preferentially displaced by a liquid of the right surface tension. The mechanism for capillarity is dependent on the surface free energy of the system. For spontaneous spreading of the liquid to occur, the surface free energy of the system must decrease during the spreading process. This can be accomplished for the devices used herein, by selecting the appropriate solid surfaces for the biologic fluid of interest.

"Chamber", as used herein, is an enclosed space or cavity of defined dimensions. The chamber may have inlet and outlet openings. The chamber can be filled by capillary forces or by differential pressure. The control of dimensions for a particular chamber allows for independent control of reagent additions, flow, incubation, reaction zones, or detection.

"Conjugation," as used herein, is the chemical coupling of one moiety to another to form a conjugate. Coupling agents for covalent conjugation to protein have been described in U.S. Pat. No. 5,053,520, the entirety of which is hereby incorporated by reference. Homobifunctional agents for coupling enzymes to antibodies are also known in the art as described in P.C.T. Publication Number WO 92/07268, published on Apr. 30, 1992.

"Inlet port", or "entry port", or sample in are terms that are synonymous. They refer to the site where the test sample is introduced into the analytical device. The site accesses a receiving area of the device. The receiving area of the device can be a chamber or a capillary.

"Ligand" is defined as a chemical group or molecule capable of being bound or conjugated to another chemical group or molecule. Ligands are molecular species that are capable of competing against or inhibiting the binding of the analyte. Such a ligand can be a small molecule or a macromolecule. Examples of ligands include theophylline, antibiotics, peptides, proteins, carbohydrates, lipids and nucleic acids. Preferably, smaller molecular weight oligopeptides which represent or mimic the epitopes of the analytes are used. Hetero- or homo- bifunctional, or photoreactive linkers can be used. Examples of linkers include carbodiimide, glutaraldehyde, haloformate, iodoacetamide, maleimide, N-hydroxysuccinimide, 1,5-difluoro-2,4-dinitrobenzene, imidate, aryl azide, arylacid hydrazide, and p-nitrophenyl-2-diazo-3,3,3-trifluoropropionate.

"Reaction mixture," as used herein, means a mixture of the test sample and other biological, chemical, and physical substances and reagents used to apply the present invention for the detection of analyte in the test sample. The reaction mixture can also include diluents and buffers.

"Sidewalls," as used herein, means the boundaries of the track for the test sample. The sidewalls can be created by removing material from a core layer in a multi-layer housing or removing material from a single material housing.

"Test sample," as used herein, means the sample containing an analyte to be detected and assayed using the present invention. A test sample can contain other components besides the analyte, can have the physical attributes of liquids, biological liquids, or a solid wherein the solid can be made soluble in a liquid, and can be of any size or volume, including for example, a moving stream of liquid. The test sample can contain any substances other than the analyte as long as the other substances do not interfere with the analyte or the analyte-analog. Examples of test samples include, but are not limited to: serum, plasma, spinal fluid, sputum, seminal fluid, amniotic fluid, urine, saliva, other body fluids, and environmental samples such as ground water or waste water, soil extracts and pesticide residues.

"Track(s)," as used herein, means the area within the device in which the test sample flows. Generally, the track is made out of a hydrophobic material and forms the hydrophobic sidewalls of the device. The track is generally formed by removal of a portion of the hydrophobic material in the core layer. Generally, the track has access to the inlet port of the device and extends from the inlet port access for a predetermined length necessary to carry out the desired assay. The track length will be sufficient in length to carry out the necessary functions and procedures, via capillaries and chambers, for analyte determinations and detections.

DESCRIPTION OF THE INVENTION

This invention provides devices and methods, where the devices rely on capillary action or differential pressure to pump fluids through chambers in order to control measurement of fluids, reaction times, and mixing of reagents, and to determine a detectable signal. By varying the path through which the fluid flows, one can provide for a variety of activities such as mixing, incubating, reacting and detecting.

The methods may involve binding of members of a specific binding pair resulting in complex formation. The complex formation can provide for a variety of events which can be detected by instrumentation or visual means. Alternatively, the methods may involve chemical reactions, e.g., the detection of glucose, or serum enzymes which result in a detectable change in the sample medium. Since the devices rely upon capillaries or other chambers to control movement of fluids, accurate control of dimensions of the internal chambers is essential.

The sample, e.g. test samples containing an analyte to be detected, may be a fluid which is used directly as obtained from the source or may be pretreated in a variety of ways so as to modify its character. The test sample will then be introduced into the device through an inlet port, the inlet port accesses a receiving area of the track. The receiving area of the track will be either a chamber or a capillary. The test sample will then transfer through the device passing through the capillaries and/or chambers where the test sample will encounter one or more reagents. The reagents will typically involve a system in which a detectable signal is produced.

Any liquid test sample may be employed, where the test sample will have a reasonable rate of flow due to the pumping of the capillary action or differential pressure applied. It is to be understood that the capillary action or differential pressure is the driving force. Capillary action depends on three critical factors; first, the surface energies of the gas, the surface on which the fluid flows, and the fluid, second, the dimensions of the capillary channel, and third, the efficiency of venting. The flow rate for both capillary flow and differential pressure flow will be influenced by the geometry of the capillary or chamber and the viscosity of the fluid. For differential pressure flow, the flow rate can be further impacted by increasing or decreasing the differential pressure. Where the test sample is too viscous, it can be diluted to provide for a capillary pumping rate which allows for the desired manipulation such as mixing and a reasonable flow time which will control the time period for the assay.

Differential pressure may be used to move the test sample in the device. Methods of applying differential pressures include, but are not intended to be limited to, motors, pumps, vacuums or the like.

The test sample may be derived from a source such as, but is not intended to be limited to, a physiological fluid such as blood, saliva, ocular lense fluid, cerebral spinal fluid, pus, sweat, exudate, urine, milk or the like. The test sample may be subject to prior treatment such as but not limited to addition, separation, dilution, concentration, filtration, distillation, dialysis or the like. Besides physiological fluids, other liquid test samples may be employed and the components of interest may be either liquids or solids whereby the solids are dissolved in a liquid medium.

The analytes of interest are widely varied depending upon the purposes of the assay and the source of the test sample. Analytes may include a protein, a peptide, an amino acid, a carbohydrate, a hormone, asteroid, a vitamin, a lipid, a nucleic acid, a peptide, a trace element, a drug including those administered for therapeutic purposes as well as those administered for illicit purposes, a bacterium, a virus, and a metabolite. Aggregation of molecules may also be of interest particularly naturally occurring aggregations such as viroids, viruses, cells, both prokaryotic and eukaryotic including unicellular microorganisms, mammalian cells such as lymphocytes, epithelial cells, neoplastic and the like. Additionally, analytes can be any substance for which there exists a naturally occurring binding molecule (e.g., an antibody) or for which a binding molecule can be prepared, and the analyte can bind to one or more binding molecules in an assay. Analyte thus includes antigenic substances, haptens, antibodies, and combinations thereof.

Phenomena of interest which may be measured may be indicative of physiological or non-physiological processes such as, but not intended to be limited to, blood clotting platelet aggregation, complement mediated lysis, polymerization, agglutination, or the like.

The test sample medium employed may be naturally occurring medium or the test sample can be introduced into a liquid medium which provides the desired characteristics necessary for capillary pumping action and a detectable signal. For the most part, aqueous media will be employed and to that extent, aqueous media will be exemplary for the medium employed for the subject invention. Additives and solvents can be added to the aqueous media to increase or decrease oxygenation, stability and fluidity. .

Other additives may be included for specific purposes. Buffers may be desirable to maintain a particular pH. Enzyme inhibitors may be included as well. Other reagents of interest are, but are not intended to be limited to, antibodies, preservatives, stabilizers, activators, enzyme substrates and cofactors, oxidants, reductants, or the like.

Figure 2:
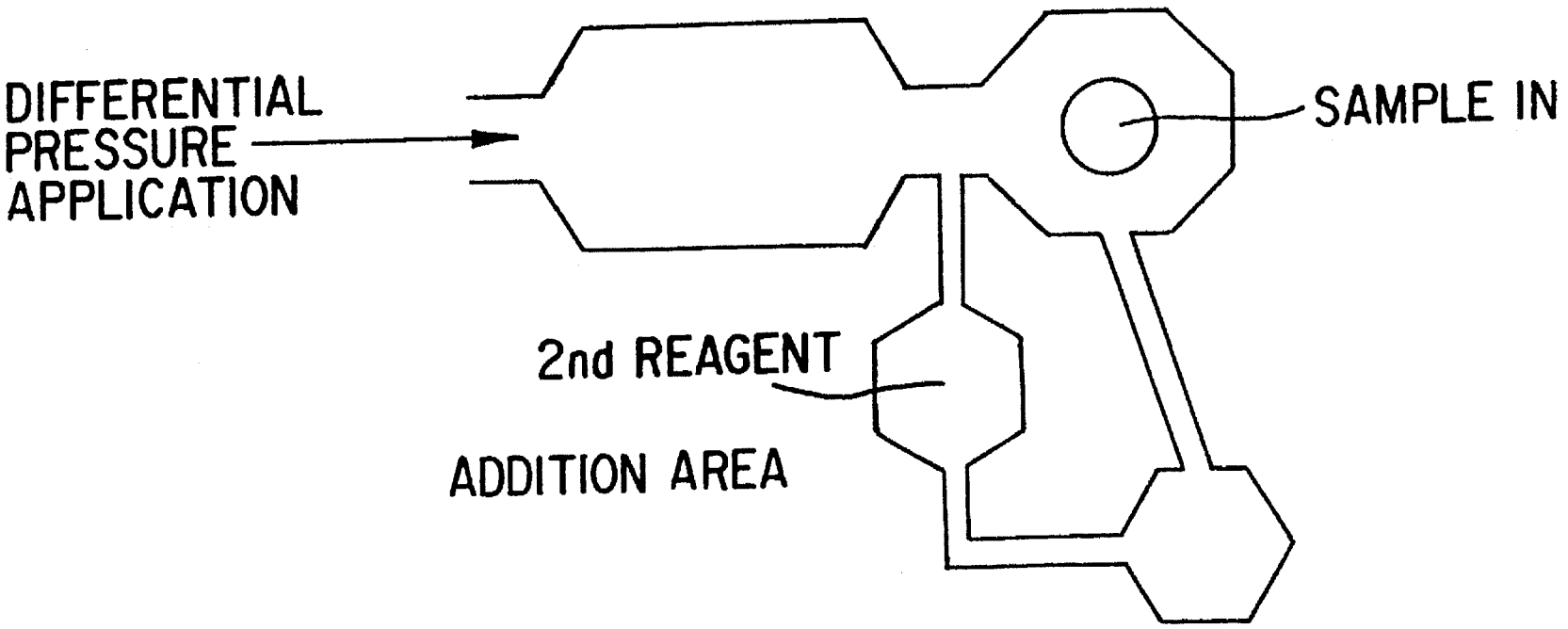
FIG. 2 illustrates a multichambered device for multistep assays.

In addition, filtration or trapping devices may be included in device pathway so as to remove particles above a certain size. The particles may include, but are not intended to be limited to, cells, virus latex particles, high molecular weight polymers, nucleic acids by themselves or in combination with proteins such as nucleosomes, magnetic particles, ligands or receptor containing particles or the like. FIG. 2 shows various regions that can be used for reagent addition, filtration and the like as well as having separate areas where capillary action and differential pressure drive the reaction.

Test samples may provide a detectable component of the detection system or such components may be added. The components will vary widely depending on the nature of the detection system. One such detection method will involve the use of particles, where particles provide for light scatter or the change of the rate of flow. Particles may be, but are not intended to be limited to, cells, polymeric particles which are immiscible with a liquid system, latex particles, charcoal particles, metal particles, polysaccharides or protein particles, ceramic particles, nucleic acid particles, agglutinated particles or the like. The choice of particles will depend on the method of detection, the dispersability or the stability of the dispersion, inertness, participation in the change of flow, or the like.

Other methods of detection include, but are not intended to be limited to, changes in color, light absorption, or transmission of fluorescence, change in physical phase or the like. The test sample will be introduced into the inlet port into a receiving area of the track. The receiving area may be a capillary or a chamber. The receiving area may be used to measure the particular sample volume or may simply serve to receive the sample and direct the sample to the next area of the device. A capillary may serve a variety of functions including a measuring device for volume measurement, a metering pump for transferring liquid from one chamber to another, a flow controller for controlling the rate of flow between chambers, a mixer for mixing reagents and a detecting area for detection. For the most part, the capillaries will serve as transfer areas, flow control areas and detection areas. Generally, the chambers may be used to define events, e.g., zones of reaction, or different structural entities in certain embodiments of the invention.

The capillaries will usually be of substantially smaller cross-section or diameter in the direction transverse to the direction of flow, than the chambers. The cross-section or the length of directional flow may be similar or may differ depending on the function of the capillary and the chamber. The first capillary will usually control a rate of flow into a chamber which will usually serve as a reaction chamber. Thus, the capillary may aid in the control of the time with which the assay medium is in contact with reagent contained within or bound to the wall of the reaction chamber. The capillary can also control the progress of the assay medium through the chamber. Additionally, the reagent can be contained within or bound to the wall of the capillary itself. Other components which may affect the rate of flow in the chamber include baffles, walls, supports or other impediments in the chamber, the geometry of the chamber, the reagent in the chamber and the nature of the surfaces of the capillary and chamber.

Depending upon a particular system, the length of the capillaries, their cross-sectional area, the volume of various chambers and their length and shape may be varied widely. One constraint on each of the capillaries is a necessity for their function providing capillary pumping action for flow. The capillary or differential pressure provides the driving force for the movement of liquid through the device. Flow rate will be determined by viscosity of the liquid sample, geometry of the track, tortuosity of the track, vapor pressure of the sample, hydrostatic head pressure, impediments in the track, and efficiency of venting. The combined surface characteristic of the capillaries and chambers must be hydrophilic in nature for flow to occur in a capillary driven format.

If differential pressure is used, there is less restriction on selection of surface properties.

The selection of material of the present invention also requires a self-venting material along at least one of the surfaces at or beyond the chamber being filled. The self-venting material is porous in nature with hydrophobic walls which do not allow liquid to pass through the material. If necessary, any of the surfaces of the hydrophobic vent can be treated to render it hydrophilic on the surface contacting the fluid. In this manner, the interior zones of the hydrophobic material can still act as a liquid block, while maintaining the surface capillarity desired for transporting the liquid sample. Hydrophobic materials suitable for the present invention include, but are not intended to be limited to, acrylics, polycarbonates, polystyrenes, silicones, polyurethanes, polyolefins, polytetrafluoroethylenes, polypropylenes, polyethylenes, thermoplastic elastomers, and copolymers such as acrylnitrylbutadienestyrene and styreneacrylonitrile, or the like.

The chambers also have a variety of functions, serving as protection for the reagents, mixing chambers for dissolution of reagent, reaction of the test sample with the reagent, volume measurement, incubation, detection, or the like. Chambers will be primarily employed for mixing, reacting, incubating and for holding of the test sample. The self-venting material can be used to supply oxygen or other gases required in the chamber. The oxygen or other gases can permeate from outside the device through the self-venting material and into the chamber. The self-venting material will allow quick and more uniform supply of oxygen, e.g., in an enzymatic reaction with an oxidase enzyme. These reactions will tend to be substrate limited rather than oxygen limited because the reaction can extend the length of the track due to the oxygen input into the reaction from outside the device. Generally, the self-venting material will cover the entire length of the track so as both capillaries and chambers are lined with the self-vent material.

Conversely, the self-vent can be restricted to only particular regions of the track so as to prevent gas permeation, slow down fluid movement, increase reaction time in the chamber, or control other aspects of the reaction. In addition, capillary action can be coupled with differential pressure to drive the reaction. In this respect, areas of mixing, reaction, detection, and the like can be created to utilize both capillary action and differential pressure to drive the test sample throught the device.

In addition, the devices can be constructed to conviently fit directly into instrumentation for detection purposes. An example of such a method would be to create a self-venting device which can fit into a spectrophotometer much like a cuvette. In this manner, detection can be read directly from the device in the instrumentation.

In order to minimize handling of reagents by the user of the device, reagents may be supplied within the device, usually in at least one chamber, whereby the mixing of the test sample with reagents occurs in the chamber. The reagents may be present either diffusively or non-diffusively bound to the surface of the chamber, that is, adhered, absorbed, adsorbed or covalently linked, so that the reagent may become dissolved in the test sample or may remain fixed to the surface. Techniques of putting reagents down can include but are not limited to reagent jetting, spotting and the like. Where the reagents are diffusively bound (non-covalently and weakly bound), a variety of situations can be accommodated. One situation is where the test sample liquid front dissolves all the reagents so that the test sample liquid front receives a high concentration of the reagent and most of the reaction occurs at the test sample liquid front. A second situation would be with a reagent of limited solubility. In this situation, the reagent may be present in the test sample at a substantially uniform concentration. The third situation has a limited amount of a reagent of limited solubility, so the test sample liquid front will have a relatively constant reagent concentration.

In many instances, it is essential that the reagent be present in the reaction chamber which makes fabrication of an internal chamber followed by later addition of reagent difficult. While for the most part the reagent will be present in one or more chambers of the device, reagents can also be mechanically introduced by various techniques. For example, by employing a septum, a syringe may be used to introduce a reagent. Alternatively, one could have an orifice or use an eyedropper or other means by introducing liquid reagent into the device. Usually, unless essential, these alternative techniques will be avoided.

The reagent will vary depending on the nature of the test sample, the analyte, and the manner in which detectable signal is generated. One embodiment of the present invention includes a chemical reaction which occurs due either to the formation of covalent bonds, e.g., oxidation or reduction, hydrolysis, or noncovalent bonds, e.g., complex formation between ligand and receptor, including complex formation between nucleic acids. The same or different reagent may be present in the various chambers, so that successive reactions can occur or a reagent continually supplied into the test sample.

In addition, the device can employ a plurality of chambers and capillary channels. The chambers can be varied in size and purpose, providing the varying incubation times, varying reaction times, mixing of media from different capillaries, or the like. Any number of chambers may be employed, and may line up in parallel, series, or a combination of the two. The size of the chamber can be particularly important where the reagent is fixed, so that the test sample residence time in contact with the reagent will be affected by the area of the reagent contacted. By employing various filtration or trapping devices, one can inhibit the transfer of particles from a capillary channel to a chamber or vice versa. In this manner, various components of the sample can be removed by employing diversion channels.

Detection, for the most part will involve the absorption, scatter or emission of light. A wide variety of protocols and reagents are available which provide for a change in measured light, as a result of absorption, scatter or emission. An example of such a detection system is the absorption of light in glucose assays. Elevated urine or plasma glucose is correlated with diabetes mellitus. In the case of diabetes mellitus, it is often advisable to be able to quantitate plasma or urine glucose levels as a means to better control side effects of the disease. One of the methods most often utilized for glucose measurement correlates changes in absorption or reflectance of the medium with glucose concentration. One common method for glucose determination employs glucose oxidase (GOD) and peroxidase (POD) along with 4-aminoantipyrene (4-AAP) and dichlorohydroxybenzene sulfonate (DCHBS) to measure glucose levels in urine or serum. The chemistry involved is as follows:

$$\text{glucose} + O_2 \xrightarrow{\text{GOD}} \text{gluconic acid} + H_2O_2 \quad (1)$$

-continued $$H_2O_2 + 4\text{-AAP} + \text{DCHBS} \xrightarrow{\text{POD}} \text{Quinoimine Dye} + H_2O \quad (2)$$

In this system, one mole of oxygen is consumed for each mole of glucose oxidized. Normal plasma glucose concentrations (60–100 milligrams/deciliter (mg/dL) represent concentrations between 3.3 and 5.5 millimolar (mM). In diabetes mellitus, elevated plasma glucose levels can reach 500 mg/dL (27.8 mM), and can be as high as 5% (278 mM) in urine. In aqueous medium, oxygen's solubility is near 1.3 mM. As a result, assay reaction (1) is dependent on an accessible supply of molecular oxygen to allow it to run to completion. Failure to supply an adequate oxygen amount dooms the reaction to an inaccurate measurement of glucose concentration because a non-stoichiometric amount of $H_2O_2$ is produced by reaction (1). In most cases, molecular oxygen is supplied to the reaction by frequent mixing of reaction tubes or cuvettes, allowing molecular oxygen from the air to saturate the reaction solution.

An advantage of the present invention is that the hydrophobic, porous side walls provide a ready source of molecular oxygen from outside the device. The assay of glucose using glucose oxidase is by no means unique. Many other assay methods employ molecular oxygen as an assay reagent. Examples are enzymatic cholesterol assays that make use of cholesterol oxidase, alcohol can use alcohol oxidase, and bilirubin can be measured using bilirubin oxidase. Many other assays can also be configured with oxidases. Such assays include but are not limited to oxidase reactions. All of these assay methods could benefit from a cuvette or reaction vessel which provided an open surface through which molecular oxygen could easily penetrate.

Labels which may be employed include enzymes in combination with substrates, co-factors or inhibitors, fluorescers, combinations of fluorescers and quenchers, dyes and the like. In some instances, the chemical reaction occurs as a result of the presence of the analyte or with the analyte, which provides a detectable signal. By employing appropriate protocols, the amount of absorption or emission of light and the detection unit can be directly related to the amount of analyte in the sample.

Detection by the measurement of light, for example, scatter, can be used to measure the size population. This can be particularly useful for the measurement of agglutination clumping, conformation or dissolution, and the like. A laser is able to distinguish particles without a change in the flow rate. Small particles have a low frequency and a high amplitude whereas large particles such as agglutinated particles have a lower frequency and a higher amplitude. Thus, the change in particle size and distribution may be detected by integrated noise employing known circuitry.

Additionally, detection of the change in the rate of flow may be the signal which reacts from the label or may be the result of a combination of a plurality of entities which apply to the rate of flow. The change in the flow rate may be the result of agglutination, a complex formation of high molecular weight compounds or aggregations, or the like.

The device can be fabricated from materials with the appropriate physical properties, which include optical transmission, thermal conductivity, and mechanical properties and which allow for uniform coding and stability of reagent, as well as medium compatibility. The device can be fabricated in a variety of ways. The chambers can be formed in a plastic sheet by vacuum forming, injection molding, casting, sintering, machining, or hot stamping. Capillaries and tracks may be formed by chemical or plasma etching a channel into the plastic, similar to the etching performed on photoresists in the semi-conductor fields. The device can be sealed by placing another material on the plastic sheet and sealing with various methods such as but not limited to ultrasonic welding, solvent bonding, adhesive bonding such as adhesive tapes, or the like. Films from extrusion, casting, sintering, or blow molding can be fabricated. Sandwich layers may be die or laser cut from these films of desired thickness which would then be coated with adhesive and sandwiched. The adhesive could also be silk screened on to the base to give a raised pattern of desired thickness. The sheet thickness of the device in the region of the capillary channels will generally be sufficient to prevent compression to the capillary action. The self-vented portion of the device can be incorporated as the adhesive layer, the capillary, the chamber, or a film layer. The adhesive layer if acting as a self-vent can be processed by applying an incomplete pattern with islands of adhesive to allow the uncoated regions to act as the hydrophobic vent. The islands are sufficiently hydrophobic to be impermeable to the test sample. Self-venting materials as plastic parts or films can be processed by casting, sintering, extrusion, solution, stretching, or other methods which can introduce voids into the structure. Common porous media are generated by cellulosics, cellulose esters, nylons, polycarbonate, polypropylene, polyethylene, polyesters, polytetrafluoroethylene, acrylics, polysulfones, and ceramics.

It is to be understood that this invention utilizes adhesives for different purposes. First, adhesives are used primarily for their bonding capabilities. The adhesives can be applied to secure devices. These adhesives can also be used in a manner to vent the device. Second, an adhesive system can be applied to a permeable surface to render it hydrophobic. The adhesive systems are primarily used for their ability to render the permeable surfaces hydrophobic and are not used for their adhesive qualities. It may be necessary to use an additional adhesive for its adhesive properties to bond the device where an adhesive system has been used to render a permeable surface hydrophobic. The use of an adhesive system is discussed in detail later in this document.

While other materials may be used for fabrication, such as glass, for the most part these materials lack one or more desirable characteristics to the indicated materials, and therefore have not been discussed. However, there may be particular situations where glass, ceramics, or other materials may find application, such as a glass window for optical clarity, modification of surface tension, and the like.

The device will normally include a reagent within a reaction chamber. The reagents may be formulated prior to or with various additives. The manner in which it is formulated, produced chamber, must provide for mixing with the test sample, reproducible distribution in the chamber, stability during storage, and reproducible reaction with the test sample.

Once the various materials are mixed for the test sample, the sample medium would be introduced to the receiving chamber and transferred by capillary action into the next chamber. Either visual evaluation of the flow rate change or an electromechanical evaluation may be employed. The initiation will flow through the first capillary channel or through a successive capillary channel may be selected as the initiation time for measurement, or some point in between.

The present invention includes analytical devices which employ the aforementioned components and techniques while providing a self-venting mechanism. Analytical devices typically employ vent ports which may be deferentially activated when necessary. The present invention utilizes materials which allow the elimination of such vent ports by supplying a device that can vent continuously or in a controlled fashion, based on the materials employed as well as provide for venting along the length of a capillary track device. Materials which provide for gaseous porosity yet maintain a hydrophilic surface that maintains good test sample fluid flow are necessary.

According to one embodiment of the present invention, an analytical device is comprised completely of a hydrophobic material. Such a device includes an inlet port accessing a track that was bored into the material. The surface on which the test sample will flow upon inside the device can be chemically treated to create a hydrophilic surface. The hydrophilic surface can have reagents applied onto its surface and accessible when the test sample is introduced into the device. The track typically has a capillary channel which can provide a means for the fluid to travel to various reaction zones and chambers. Additionally, the device must vent gases trapped in the device out through the material. The porous material also allows oxygen into the device whereby particular assays can be facilitated by the utilization of oxygen.

In addition, according to another embodiment of the present invention, an analytical device can comprise at least two materials. Such devices can use layers of material superimposed on each other and bonded together by various adhesives. This permits a stratification of layers whereby some layers can be hydrophobic while some layers are hydrophilic. As shown in FIG. 1 there can be a top layer containing an inlet or entry port, a core layer comprised of a material wherein some material is removed to create a track. The track has sidewalls along its length and width which will generally create the boundaries of which the test sample can flow. There can be a bottom or base layer comprising a surface upon which the test sample will flow upon within the boundaries of the track. Generally, all the layers will be impermeable to liquid. Once again, the venting of gases from inside the device to the outside is accomplished by selecting hydrophobic materials which can allow gaseous exchange in and out of the device but not biological liquids such as test samples.

As mentioned above, a hydrophobic surface upon which the test sample will flow can be modified to render it hydrophilic and hence more wettable. Creating wettable surfaces can include, but is not limited to, wet chemical modification, surface coatings, gas modification, plasma deposition, or plasma modification. These procedures introduce hydrophilic groups such as hydroxyls, carbonyls, carboxylics, aminos, sulfonics, sulfonates, sulfates, pyrroles, acetates, acrylics, carbonates, amidos, and phosphates onto the hydrophobic surface. In the alternative, materials such as surfactants can be applied to the hydrophobic surfaces to enhance wettability as recognized by those skilled in the art. In addition, both hydrophilic groups can be introduced onto the hydrophobic surface by the above techniques and materials such as surfactants applied in unison. These techniques can be used in various procedures and combinations with the present invention.

Conversely, another embodiment of the present invention utilizes the analytical devices to include forms of impregnated hydrophilic, liquid permeable materials. The impregnation of the hydrophilic, liquid permeable material renders the material hydrophobic and therefore impermeable to the test sample. Examples of such hydrophilic materials include, but are not intended to be limited to, bibulous materials and polymer screens. Bibulous materials can include fibers, filter papers, cellulosic materials and the like.

The bibulous materials or screens can be impregnated with adhesive systems to render them hydrophobic. The general class of "adhesive systems" which can be used within the scope of the present invention are those which will create a hydrophobic material that is impermeable to the test sample yet porous to gas exchange. It is not primarily for the adhesive properties that the adhesive systems are utilized but for attaining a hydrophobic, porous feature in the analytical device design. There are a variety of adhesive systems suitable for use in the invention and a criteria for selection is the difference each subclass of an adhesive system uses to allow a solid to liquid conversion and vice-versa. Adhesive systems require a liquid state to allow wetting at the surface of the hydrophilic, liquid permeable materials. The liquid state is required to allow impregnation into the structure. This results in subsequent blockage of liquids across the surface interface.

One such example of an adhesive system is the use of hot melt adhesives. Typically, hot melt adhesives are solids at room temperature and heat is used to convert the adhesive to a liquid which allows wetting and impregnation of the hydrophilic, liquid permeable material. The material is allowed to cool after impregnation to allow the adhesive to solidify. Examples of commercially available hot melt adhesives are: Tanner Tivomelt® 9600 (Tanner, Greenville, S.C.); Eastobond A-605® (Eastman-Kodak, Kingsport, Tenn.); and Bostik Thermogrip 2391® (Bostik, Middleton, Mass.). In addition, polymers can be used as hot melt adhesives such as, but are not intended to be limited to, nylons, polyolefins, waxes, ethylenevinylacetates, polyesters, polyurethanes, and polyethylenes.

Another example of an adhesive system is a one part heat curable. Typically, one part curables are liquids at room temperature due to the low molecular weight of their starting components. The one part curable is applied in its liquid form to the hydrophilic, liquid permeable material to allow impregnation. Upon heating the impregnated hydrophilic material, a temperature induced reaction occurs which polymerizes the liquid and converts it to solid state. Epoxies are the most common reaction chemistries, but polyimides, urethanes, and silicones can also be used. Examples of commercially available one part heat curables are: A-3888® (Engelhard Corp., East Newark, N.J.); and National Starch Screenimid 9010™ (National Starch, Bridgewater, N.J.). In addition, two part heat curables can be used. In two part heat curables, solvents can be added to lower viscosity to improve processing. These solvents can then be driven off by heat prior to curing. Two part curables that are not heated can also be used.

Another example of an adhesive system is a solvent based/emulsion system. Such systems contain solids that are solubilized or suspended in a liquid solvent for the application. After impregnation of the hydrophilic, liquid permeable material, the liquid is driven off by drying. The drying can be accelerated by heat or can occur at ambient or vacuum assisted conditions. Examples of commercially available solvent based/ emulsion systems are: Polygard NF-100® (Ferro, Santa Barbara, Calif.); 6C-33 (Olin-Hunt, Ontario, Calif.); and AS-100P (Teknek, Renfrewshire, Scotland, UK.).

Yet another example of an adhesive system are ultraviolet (UV) curables. UV curables are similar to heat curables in that the starting components are liquid at room temperature. After application and impregnation of the hydrophilic, liquid permeable material, a UV light source is used to induce a reaction that converts the adhesive system components to a solid. Examples of commercially available UV curables are:

UV D40-90 (Colonial, E. Rutherford, N.J.); and Masterbond UV-15® (Masterbond, Teaneck, N.J.). Other adhesive systems may be used with the present invention. Another adhesive system is a water induced cures common for silicone room temperature vulcanizers.

The adhesive systems can be applied as a complete coating or can be applied as islands. The islands impregnate the hydrophilic, liquid permeable material and render it hydrophobic. The islands can be applied as a pattern or randomly. There must be sufficient application of islands to provide a hydrophobic material which is impermeable to the test sample yet able to allow gaseous exchange in and out of the material.

The Examples below are embodiments of both devices and methods of the present invention. The embodiments are examples and are not a limitation of the present invention. Each of the below Examples' devices were constructed and tested in three constructions. Where there was a difference in the performance of any device, the differences are listed in the Examples.

EXAMPLE 1

A device was constructed containing a top layer of Pilcher Hamilton Film (Pilcher Hamilton Corporation, Greer, S.C., 29651) with an inlet port of 0.25 inches. An MA-38 adhesive (Adhesives Research, Glen Rock, Pa., 17327) was applied to the under surface of the top layer. The core layer was Pilcher Hamilton Film with a 0.25 inch wide track. The bottom or base layer was a Pilcher Hamilton Film with a MA-38 adhesive applied to the top surface of the bottom layer. A 100 microliter (μl) water sample was added to the inlet port. The water sample entered the track for approximately 2 millimetres (mm) but did not continue to fill the track. This device was used as a control.

EXAMPLE 2

A device was constructed containing a top layer of Pilcher Hamilton Film with an inlet port of 0.25 inches. An MA-38 adhesive was applied to the under surface of the top layer. The core layer was Pilcher Hamilton Film with a 0.25 inch wide track. The bottom layer was a Pilcher Hamilton Film with a MA-38 adhesive applied to the top surface of the bottom layer. A vent hole was punched at the end of the track. A 100 μl water sample was added to the inlet port and the track filled smoothly. This was used as a second control.

EXAMPLE 3

A device was constructed containing a top layer of Pilcher Hamilton Film with an inlet port of 0.25 inches. An MA-38 adhesive was applied to the under surface of the top layer. The core layer was Pilcher Hamilton Film with a 0.25 inch wide track. The bottom layer was a teflon membrane (W. L. Gore & Associates, Elkton, Md., 21921) with a 0.45 μm pore size. The membrane is hydrophobic and a 100 μl water sample added to the inlet port was repelled so strongly that it failed to enter the track and collected on the upper surface of the top layer.

EXAMPLE 4

A device was constructed containing a top layer of Pilcher Hamilton Film with an inlet port of 0.25 inches. An MA-38 adhesive was applied to the under surface of the top layer. The core layer was Pilcher Hamilton Film with a 0.25 inch wide track. The bottom layer was a hydrophobic gas permeation layer (General Electric Co., Schenectady, N.Y., 12345). A 100 μl water sample failed to enter the track and collected on the upper surface of the top layer.

EXAMPLE 5

A device was constructed containing a top layer of Pilcher Hamilton Film with an inlet port of 0.25 inches. An MA-38 adhesive was applied to the under surface of the top layer. The core layer was Pilcher Hamilton Film with a 0.25 inch wide track. The bottom layer was a Celgard microporous polypropylene engineering film composite (Celanese, Charlotte, N.C., 28232) with a MA-38 adhesive applied to the top surface of the bottom layer. The bottom layer had a hydrophobic side oriented towards the inside of the device, A 100 μl water sample failed to enter the track but was not repelled onto the upper surface of the top layer.

EXAMPLE 6

A device was constructed containing a top layer of Pilcher Hamilton Film with an inlet port of 0.25 inches. An MA-38 adhesive was applied to the under surface of the top layer. The core layer was Pilcher Hamilton Film with a 0.25 inch wide track. The bottom layer was a Celgard microporous polypropylene engineering film with a MA-38 adhesive applied to the top surface of the bottom layer. The porous, hydrophilic surface of the bottom layer film was oriented toward the inside of the device. A 100 μl water sample flowed into the track and air bubbles were eliminated due to the venting of the polypropylene film.

EXAMPLE 7

A device was constructed containing a top layer of Pilcher Hamilton Film with an inlet port of 0.25 inches. An MA-38 adhesive was applied to the under surface of the top layer. The core layer was Pilcher Hamilton Film with a 0.25 inch wide track. The bottom layer was a Tetko polyethylene monofilament woven screen (Tetko, Elmsford, NY., 10523) with 136 μm pores and 37% open area, with a MA-38 adhesive applied to the top surface of the bottom layer. A 100 μl water sample entered the track for approximately 2 mm but did not continue to fill the track.

EXAMPLE 8

A device was constructed containing a top layer of Pilcher Hamilton Film with an inlet port of 0.25 inches. An MA-38 adhesive was applied to the under surface of the top layer. The core layer was Pilcher Hamilton Film with a 0.25 inch wide track. The bottom layer was a Whatman filter paper (Whatman, Inc., Clifton, N.J., 07014) with a MA-38 adhesive applied to the top surface of the bottom layer. A 100 μl water sample filled the track and filter paper at equal rates. One of the three devices trapped an air bubble at the end of the track.

EXAMPLE 9

A device was constructed containing a top layer of Pilcher Hamilton Film with an inlet port of 0.25 inches. An MA-38 adhesive was applied to the under surface of the top layer. The core layer was Pilcher Hamilton Film with a 0.25 inch wide track. The bottom layer was a nylon screen with a 1 μm pore size, with a MA-38 adhesive applied to the top surface of the bottom layer. A 100 μl water sample filled the track first and then fluid entered into the nylon screen and eventually leaked from the nylon screen.

EXAMPLE 10

A device was constructed containing a top layer of Pilcher Hamilton Film with an inlet port of 0.25 inches. An MA-38 adhesive was applied to the under surface of the top layer. The core layer was a Porex HDPE (Porex, Fairburn, Ga., 30213) with a 0.25 inch wide track. The bottom layer was a Pilcher Hamilton Film with a MA-38 adhesive applied to the top surface of the bottom layer. A 1000 μl water sample flowed into the track. An air bubble formed in the track but was eliminated.

EXAMPLE 11

A device was constructed containing a top layer of Pilcher Hamilton Film with an inlet port of 0.25 inches. An MA-38 adhesive was applied to the under surface of the top layer. The core layer was a Delrin non porous core 0.125 inch wide track. The bottom layer was a Pilcher Hamilton Film with a MA-38 adhesive applied to the top surface of the bottom layer. A 1000 μl water sample would not enter the track.

EXAMPLE 12

A device was constructed containing a top layer of Pilcher Hamilton Film with an inlet port of 0.25 inches. An MA-38 adhesive was applied to the under surface of the top layer. The core layer was composed of double stick tape whereby the tape has irregular islands on its adhesive surface creating channels for air flow (3M Corp., St. Paul, Minn., 55144). The bottom layer was a Pilcher Hamilton Film with a MA-38 adhesive applied to the top surface of the bottom layer. A 100 μl water sample filled the track smoothly with no air bubbles.

EXAMPLE 13

A device was constructed containing a top layer of Pilcher Hamilton Film with an inlet port of 0.25 inches. A double stick adhesive tape (3M) was applied to the under surface of the top layer. The core layer was composed of filter paper impregnated with a heat cured epoxy. The heat cured epoxy essentially coated the filter paper fibers rendering them hydrophobic while leaving the spaces between the coated fibers porous to gases. The bottom layer was a Pilcher Hamilton Film with a double stick adhesive (3M) applied to the top surface of the bottom layer. A 100 μl test samples of glucose standards filled the track smoothly with no air bubbles.

Adhesive systems can be vacuum drawn through the filter paper as was the heat cured epoxy. The epoxy used was A-3888® from Engelhard Corp., (East Newark, N.J.).

The device that was constructed in Example 13 was read by placing the device in a cuvette and read by a Beckmann DU 470 Spectrophotometer (Beckman Instruments, Inc., Fullerton, Calif., 92634). The device was read at absorbance =513 nm. The assay was performed as follows:

Solution A was comprised of:

1. 0.0056 grams (g) of magnesium chloride (Fisher Scientific, Pittsburgh, Pa., 15219)
0.370 g of bovine serum albumin (Boehinnger Mannheim Corp., Biochemical Products, Indianapolis, Ind., 46250)
3. 0.0934 g of 4-AAP (Sigma Chemical Co., St. Louis, Mo., 63178)
4. 0.90 g of glucose oxidase (Sigma)
5. 8.1. milliliters (mL) of 50 mM MOPSO (Sigma)

Solution B was comprised of:

1. 0.403 g of DCHBS (Aldrich Chemical Co., Milwaukee, Wis., 53201)
2. 0.107 g of Peroxidase (Amano Pharmaceutical Co., Nagoya, Japan)
3. 5.1. mL of 50 mM MOPSO (Sigma)

The core layer was bonded to the bottom layer with a MA-38 adhesive. Five spots of 1 μl of Solution A was laid down inside the track on the bottom layer surface and allowed to dry. The five spots were located along the central longitudinal axis of the track. Ten spots of 1 μl of Solution B were laid down on the both sides of the Solution A spots. The Solution A and B spots were in close proximity to each other but did not touch. The top layer was bonded to the core layer with a MA-38 adhesive. The adhesive was confined in all layers to only non-track areas. A 30 μl sample of Glucose/Urea standard (Sigma) was added to the inlet port of the top layer. The reaction was allowed to proceed for thirty (30) to ensure sufficient reaction time. The device was places in a Beckman DU-70 spectrophotometer and read at 513 nm.

| Glucose concentration (milligrams/deciliter) | $A_{513}$ | % CV |
|---|---|---|
| 0 | 0.2072 | 2.7 |
| 100 | 0.7399 | 9.7 |
| 200 | 1.541 | 16.6 |
| 300 | 1.396 | 26.7 |
| 500 | 2.415 | 7.0 |
| 800 | 2.054 | 22.5 |

EXAMPLE 14

Devices which employ hydrophobic porous side walls can also be used as cuvettes for a spectrophotometer. Because of the hydrophobic porous walls, these cuvettes will fill easily. These devices were created by laminating Pilcher Hamilton film to a core layer composed of POREX (high density polyethylene) laminated on both sides with MA-38 adhesive and Scotch double stick adhesive tape. From front to back, the device was configured as follows: Pilcher Hamilton film, Scotch double stick tape, MA38, POREX, MA38, Scotch double stick tape, and Pilcher Hamilton film.

To test the reproducibility of the path length of the constructed devices, a tartrazine (Aldrich, Milwaukee, Wis, 53233) solution was prepared in phosphate buffered saline (PBS) pH=7.0 (Sigma, St. Louis, Mo. 63178) with an absorbance of 3.122 in a 1.00 cm cuvettes at 426 nm. Absorbances of dilutions of the stock solution gave a linear response in the range tested ($r^2$=0.999905, slope=0.304903 mm cuvette thickness/ 426 nm absorbance unit). PBS was introduced into each of ten cells constructed as noted above and absorbance at 426 nm was recorded. Then, the stock tartrazine solution was introduced into the same cells, and again, absorbance at 426 nm was recorded. The absorbance due to tartrazine was calculated by subtracting the absorbance due to saline from the absorbance with tartrazine. Using the slope of the dilution calibration line, cell thicknesses were computed.

| Cell # | A426, Saline | A 426 nm, Tartrazine | Difference | Cell Thickness (mm) |
|---|---|---|---|---|
| 1 | .0987 | 1.2216 | 1.1229 | 3.68 |
| 2 | .0937 | 1.1803 | 1.0866 | 3.56 |
| 3 | .1069 | 1.1821 | 1.0752 | 3.53 |
| 4 | .0951 | 1.1816 | 1.0865 | 3.56 |
| 5 | .1023 | 1.1797 | 1.0774 | 3.53 |
| 6 | .0964 | 1.2033 | 1.1069 | 3.63 |
| 7 | .0884 | 1.1762 | 1.0878 | 3.57 |
| 8 | .1049 | 1.1910 | 1.0861 | 3.56 |
| 9 | .0963 | 1.1530 | 1.0567 | 3.47 |
| 10 | 0.2537 | 1.3625 | 1.1088 | 3.64 |
| | | | Mean | 3.57 |
| | | | % CV | 1.7% |

A glucose assay was also conducted in similar hydrophobic, porous cuvettes. A reaction mixture was prepared by diluting 34 uL of Solution A (Example 13) and 17 uL of Solution B with 1 mL of PBS. Assays were run in glass tubes by mixing 2.0 uL glucose/urea standard (Example 13) with 1.05 mL of reaction mixture. The mixtures were incubated 15 min. at room temperature to ensure adequate reaction. Then, the reaction mixtures were split, a portion of the solution being read at 513 nm in a 5.00 mm quartz cuvette and a portion being read at 513 nm in the laminated cuvette described above. Reaction were run in triplicate. Results were as follows:

| Glucose (mg/dL) | Laminated Cuvettes Mean A 513 nm | % CV | 5.00 mm Quartz Cells A 513 nm | % CV |
|---|---|---|---|---|
| 0 | 0.2705 | 1.7% | 0.3004 | 0.2% |
| 100 | 0.4959 | 1.6% | 0.6305 | 1.1% |
| 200 | 0.7355 | 1.3% | 0.9654 | 0.3% |
| 300 | 0.9776 | 1.1% | 1.3308 | 0.6% |
| 500 | 1.5224 | 0.8% | 2.0778 | 0.6% |
| 800 | 2.1240 | 1.2% | 2.9373 | 1.4% |
| Slope | 0.002359 | | 0.003562 | |
| Intercept | 0.2740 | | 0.2773 | |
| $r^2$ | 0.997 | | 0.999 | |

We claim:

1. A method for detecting the presence or an amount of an analyte in a test sample, comprising providing:

(a) an analytical device comprising: a housing made of a hydrophobic material, said hydrophobic material consisting of: acrylics, polycarbonates, polystyrenes, silicones, polyurethanes, polyolefins, polytetrafluoroethylenes, polypropylenes, polyethylenes, thermoplastic elastomers, copolymers, acrylnitrylbutadienestyrene, and styreneacrylonitrile;

said housing containing an inlet port, said inlet port accessing a track of predetermined width and length within said housing and having at least one reagent therein;

said track having at least one hydrophobic surface modified to create a hydrophilic surface by introducing at least one hydrophilic group onto said hydrophobic surface, said hydrophilic group consisting of: hydroxyls, carbonyls, carboxylics, aminos, sulfonics, sulfonates, sulfates, pyrroles, acetates, acrylics, carbonates, amidos, and phosphates;

said hydrophobic material being impermeable to said test sample and allowing gaseous exchange in and out of a portion of said track;

(b) adding said test sample to said housing through said inlet port;

said test sample and said reagent producing a detectable signal upon mixing; and (c) determining the presence or an amount of an analyte in said test sample from said detectable signal.

2. The method of claim 1 wherein said analyte is a member of a group consisting of: proteins, peptides, amino acids, carbohydrates, hormones, steroids, vitamins, lipids, nucleic acids, trace elements, drugs including those administered for therapeutic purposes as well as those administered for illicit purposes, bacteria, viruses, metabolites, viroids, mammalian cells such as lymphocytes, epithelial cells, and neoplastic cells.

3. The method of claim 1 wherein said detectable signal is read directly from said analytical device.

4. The method of claim 1 wherein said detectable signal is read directly from said analytical device by an instrument.

5. The method of claim 4 wherein said instrument is a member of a group consisting of: spectrophotometers, colorimeters, fluorimeters, spectroscopies, calorimeters, reflectance meters, and conductimeters.

6. The method of claim 1 wherein said modification of said hydrophobic surface is by wet chemical modification, surface coatings, gas modification, plasma deposition, plasma modification treatments and sufactants.

7. A method for detecting the presence or an amount of an analyte in a test sample comprising providing:

(a) an analytical device comprising a first hydrophobic material and a second hydrophilic material, said first hydrophobic material consisting of: acrylics, polycarbonates, polystyrenes, silicones, polyurethanes, polyolefins, polytetrafluoroethylenes, polypropylenes, polyethylenes thermoplastic elastomers, copolymers, acrylnitrylbutadienestyrene, and styreneacrylonitrile;

said housing containing an inlet port, said inlet port accessing a track of predetermined width and length within said housing and containing a reagent therein;

said first hydrophobic material allowing gaseous exchange in and out of a portion of said track; and said track having at least one surface of said first hydrphobic material modified to create said second hydrophilic material by introducing at least one hydrophilic group onto said first hydrophobic surface, said hydrophilic group consisting of: hydroxyls, carbonyls, carboxylics, aminos, sulfonics, sulfonates, sulfates, pyrroles, acetates, acrylics, carbonates, amidos, and phosphates; and (b) adding said test sample to said housing through said inlet port;

said test sample and said reagent producing a detectable signal upon mixing; and (c) determining the presence or an amount of an analyte in said test sample from said detectable signal.

8. The method of claim 7 wherein said analyte is a member of a group consisting of: proteins, peptides, amino acids, carbohydrates, hormones, steroids, vitamins, lipids, nucleic acids, trace elements, drugs including those administered for therapeutic purposes as well as those administered for illicit purposes, bacteria, viruses, metabolites, viroids, mammalian cells such as lymphocytes, epithelial cells, and neoplastic cells.

9. The method of claim 7 wherein said detectable signal is read directly from said analytical device.

10. The method of claim 7 wherein said detectable signal is read directly from said analytical device by an instrument.

11. The method of claim 10 wherein said instrument is a member of a group consisting of: spectrophotometers, colorimeters, fluorimeters, spectroscopies, calorimeters, reflectance meters, and conductimeters.

12. A method for detecting the presence or an amount of an analyte in a test sample comprising providing:

(a) a housing having a first layer, a core layer, and a second layer, said core layer made of a hydrophobic material containing a track of predetermined width and length and having at least one reagent therein, said track having a sidewall defining the boundaries for flow of said test sample, said first and second layers being impermeable to said test sample;

at least one of said first or second layers having a hydrophilic surface;

said housing containing an inlet port, said inlet port accessing said track, at least one of said first layer, second layer, or core layer made of a porous material that will vent gases in and out of a portion of said track;

(b) adding said test sample to said housing through said inlet port;

said test sample and said reagent producing a detectable signal upon mixing; and (c) determining the presence or an amount of an analyte in said test sample from said detectable signal.

13. The method of claim 12 wherein said analyte is a member of a group consisting of: proteins, peptides, amino acids, carbohydrates, hormones, steroids, vitamins, lipids, nucleic acids, trace elements, drugs including those administered for therapeutic purposes as well as those administered for illicit purposes, bacteria, viruses, metabolites, viroids, mammalian cells such as lymphocytes, epithelial cells, and neoplastic cells.

14. The method of claim 12 wherein said detectable signal is read directly from said analytical device.

15. The method of claim 12 wherein said detectable signal is read directly from said analytical device by an instrument.

16. The method of claim 15 wherein said instrument is a member of a group consisting of: spectrophotometers, colorimeters, fluorimeters, spectroscopies, calorimeters, reflectance meters, and conductimeters.

17. An analytical device for detecting the presence or an amount of an analyte in a test sample, comprising:

a housing made of a hydrophobic material, said hydrophobic material consisting of: acrylics, polycarbonates, polystyrenes, silicones, polyurethanes, polyolefins, polytetrafluoroethylenes, polypropylenes, polyethylenes, thermoplastic elastomers, copolymers, acrylnitrylbutadienestyrene, and styreneacrylonitrile;

said housing containing an inlet port, said inlet port accessing a track of predetermined width and length within housing;

said track having at least one hydrophobic surface modified to create a hydrophilic surface by introducing at least one hydrophilic group onto said hydrophobic surface, said hydrophilic group consisting of: hydroxyls, carbonyls, carboxylics, aminos, sulfonics, sulfonates, sulfates, pyrroles, acetates, acrylics, carbonates, amidos, and phosphates; and said hydrophobic material being impermeable to said test sample and allowing gaseous exchange in and out of a portion of said track.

18. The analytical device of claim 17 wherein said track has at least one chamber.

19. The analytical device of claim 17 further comprising a reagent within said device.

20. The analytical device of claim 19 wherein said reagent is on said hydrophilic surface.

21. The analytical device of claim 17 wherein said test sample flows along said hydrophilic surface by differential pressure.

22. The analytical device of claim 17 wherein said device is a cuvette.

23. The analytical device of claim 17 wherein said modification of said hydrophobic surface is by wet chemical modification, surface coatings, gas modification, plasma deposition, plasma modification treatments, and a surfactant.

24. An analytical device for detecting the presence or an amount of an analyte in a test sample comprising:

a housing made of a first hydrophobic material and a second hydrophilic material, said first hydrophobic material consisting of: acrylics, polycarbonates, polystyrenes, silicones, polyurethanes, polyolefins, polytetrafluoroethylenes, polypropylenes, polyethylenes, thermoplastic elastomers, copolymers, acrylnitrylbutadienestyrene, and styreneacrylonitrile;

said housing containing an inlet port, said inlet port accessing a track of predetermined width and length within said housing;

said first hydrophobic material allowing gaseous exchange in and out of a portion of said track; and said track having at least one surface of said first hydrophobic material modified to create said second hydrophilic material by introducing at least one hydrophilic group onto said first hydrophobic surface, said hydrophilic group consisting of: hydroxyls, carbonyls, carboxylics, aminos, sulfonics, sulfonates, sulfates, pyrroles, acetates, acrylics, carbonates, amidos, and phosphates.

25. The analytical device of claim 24 wherein said track has at least one chamber.

26. The analytical device of claim 24 wherein said reagent is on the surface of said hydrophilic surface.

27. The analytical device of claim 24 wherein said reagent is on the hydrophobic surface of said track.

28. The analytical device of claim 24 wherein said test sample is moved along said hydrophilic surface by a differential pressure.

29. The analytical device of claim 24 wherein said device is a cuvette.

30. The analytical device of claim 24 wherein said modification of said first hydrophobic surface is by wet chemical modification, surface coatings, gas modification, plasma deposition, plasma modification treatments, and surfactants.

31. The analytical device of claim 24 wherein said hydrophilic material is modified by application of an adhesive system to a polymer screen.

32. The analytical device of claim 24 wherein said hydrophilic material is modified by an adhesive systems consisting of: hot melt adhesives, one part curables, two part curables, solvent based/emulsion adhesives, ultraviolet curables, and water induced curables.

33. The analytical device of claim 24 wherein said hydrophilic material is modified by application of an adhesive system as one or more islands.

34. The analytical device of claim 24 wherein said hydrophilic material is modified by application of an adhesive system to a bibulous material.

35. An analytical device for detecting the presence or an amount of an analyte in a test sample comprising:

a housing having a first layer, a core layer, and a second layer, said core layer made of a hydrophobic material containing a track of predetermined width and length, said track having a sidewall defining the boundaries for flow of said test sample, said first and second layers being impermeable to said test sample;

at least one of said first or second layers having a hydrophilic surface; and said housing containing an inlet port, said inlet port accessing said track of, at least one of said first layer, second layer, or core layer made of a porous material that will vent gases in and out of a portion of said track.

36. The analytical device of claim 35 wherein said track has at least one chamber.

37. The analytical device of claim 35 further comprising a reagent on the surface of said first or second layer.

38. The analytical device of claim 35 further comprising a reagent on the hydrophobic material of said track.

39. The analytical device of claim 35 wherein said test sample flows along said hydrophilic surface by differential pressure.

40. The analytical device of claim 35 wherein said device is a cuvette.

41. The analytical device of claim 35 wherein said hydrophilic surface is modified by wet chemical modification, surface coatings, gas modification, plasma deposition, plasma modification treatments and surfactants.

42. The analytical device of claim 35 wherein said core layer is a hydrophilic material which is modified by application of an adhesive system.

43. The adhesive system of claim 42 selected from the group consisting of: hot melt adhesives, one part curables, two part curables, solvent based/emulsion adhesives, ultraviolet curables, and water induced curables.

44. The analytical device of claim 42 wherein said adhesive system is applied as one or more islands.

* * * * *

UNITED STATES PATENT AND TRADEMARK OFFICE

CERTIFICATE OF CORRECTION

PATENT NO. : 5,478,751
DATED : December 26, 1995
INVENTOR(S) : Gary M. Oosta, *et al.*

It is certified that error appears in the above-indentified patent and that said Letters Patent is hereby corrected as shown below:

Column 19, line 53, change "housing" to

--said housing--.

Column 18, line 26, change "treatments" to

--treatments,--.

Signed and Sealed this

First Day of October, 1996

*Attest:*

*Attesting Officer*

BRUCE LEHMAN

*Commissioner of Patents and Trademarks*